US005105782A

United States Patent [19]

Meneely

[11] Patent Number: 5,105,782

[45] Date of Patent: Apr. 21, 1992

[54] COMPRESSION RELEASE BRAKE WITH VARIABLE RATIO MASTER AND SLAVE CYLINDER COMBINATION

[75] Inventor: Vincent A. Meneely, Langley, Canada

[73] Assignees: Jenara Enterprises Ltd.; Sharlamen Holdings Ltd., Surrey, Canada

[21] Appl. No.: 661,128

[22] Filed: Feb. 27, 1991

[51] Int. Cl.[5] ..... F02D 13/04

[52] U.S. Cl. ..... 123/321; 123/90.16

[58] Field of Search ..... 123/90.16, 321, 322

[56] References Cited

U.S. PATENT DOCUMENTS

| | | | |
|---|---|---|---|
| 4,150,640 | 4/1979 | Egan | 123/97 B |
| 4,271,796 | 6/1981 | Sickler | 123/321 |
| 4,398,510 | 8/1983 | Custer | 123/90.16 |
| 4,423,712 | 1/1984 | Mayne et al. | 123/321 |
| 4,475,500 | 10/1984 | Bostelman | 123/321 |
| 4,648,365 | 3/1987 | Bostelman | 123/321 |
| 4,655,178 | 4/1987 | Meneely | 123/321 |
| 4,706,624 | 11/1987 | Meistrick | 123/321 |
| 4,898,206 | 2/1990 | Meistrick | 137/512.3 |
| 4,932,372 | 6/1990 | Meneely | 123/321 |
| 5,000,145 | 3/1991 | Quenneville | 123/90.16 |

*Primary Examiner*—Tony M. Argenbright

*Attorney, Agent, or Firm*—Norman M. Cameron

[57] ABSTRACT

A method and apparatus for braking a multicylinder diesel engine. Some compressed gases are released from each engine cylinder near top dead center of each compression stroke on each cycle of the engine by forcing open the exhaust valve with a slave piston assembly of a two-stage master and slave cylinder combination. The slave piston assembly is moved by a master piston assembly which operatively engages an engine component which moves prior to top dead center of each compression stroke. The ratio of the area of the master piston assembly to the slave piston assembly is then increased and the exhaust valve is then opened to a preset fully cracked open position during a second stage of the master and slave cylinder combination. Loading on the engine component is reduced during the first stage and the rate of opening the exhaust valve is increased during the second stage when the force required to further open the exhaust valve has been reduced.

21 Claims, 4 Drawing Sheets

COMPRESSION RELEASE BRAKE WITH VARIABLE RATIO MASTER AND SLAVE CYLINDER COMBINATION

BACKGROUND OF THE INVENTION

1. Field of the Invention

This invention relates to compression release brakes for diesel engines.

2. Description of Related Art

Compression-release type brakes are conventionally installed on diesel engines for trucks used on highways. These brakes are used to help slow the vehicles on downhill slopes. Such brakes are operational when the throttle is closed. They operate on the principle of opening the exhaust valve just before top dead center of each compression stroke. The pistons of the engine compress the air within the engine cylinders on the compression stroke, thus slowing the engine and the vehicle. Just before top dead center of the compression stroke, the exhaust valve of each cylinder is cracked open to allow the compressed gases to escape into the exhaust system. Otherwise there would be a rebound effect whereby the compressed gases would act upon each piston during the subsequent expansion stroke, negating the braking effect achieved during the compression stroke.

Compression-release type brakes are usually in the form of a housing fitted between the cylinder head and the cylinder head cover of the engine. Each has a plurality of slave pistons, each slave piston operatively contacting one of the exhaust valves of the engine or, for example, the crosshead for engines having two exhaust valves per cylinder. There is a master cylinder associated with each slave cylinder which conventionally contacts some reciprocating component of the engine which moves at the appropriate time for the associated slave piston. Often this component is an adjustment screw of a rocker arm of the engine. The rocker arm may be, for example, moved by a push tube for a fuel injector of the engine for engines having fuel injectors operated in this manner. Otherwise, the master piston may be powered by the rocker arm for an exhaust valve of a cylinder of the engine other than the one being cracked open.

Conventional diesel engines do not have any component specially timed to power compression-release brakes. Brake manufacturers must design their brakes so they can utilize some component of the engine normally utilized for another purpose, such as the rocker arms mentioned above. Rarely, if ever, is there a component which moves at exactly the right time to crack open each exhaust valve. For example, when rocker arms for other exhaust valves are utilized, they usually begin to move earlier than the manufacturer wants the brake to crack open each exhaust valve. If the valve is cracked too early, then braking effect is lost because the air within the engine cylinder has not been compressed to its maximum extent.

There is another problem in utilizing rocker arms or other valve train components for this purpose. They are designed to open valves or operate fuel injectors and not to power engine brakes. The force required to crack open an exhaust valve just prior to top dead center of the compression stroke is considerable and may place a load on the camshaft or other valve opening components beyond their designed capacity. Accordingly, engine brake manufacturers have made various attempts to utilize rocker arms, or related components, while avoiding the problems that they move too early and then place too high a load on the camshaft and related components.

The fact that the most appropriate rocker arm moves too early to crack open each exhaust valve is usually addressed simply by allowing a gap between the slave piston and the exhaust valve stem so that the initial movement of the rocker arm does not start to crack open the exhaust valve. However, this lost motion wastes potential energy which could be used to open the valve.

The most widely adopted method for utilizing the relatively limited opening abilities of most engine camshafts, particularly their exhaust cams, has been to continuously keep the exhaust valves slightly cracked open during brake operation (typically 0.005"–0.015"). This system has been used in a number of earlier patents, for example U.S. Pat. No. 4,398,510 to Custer and U.S. Pat. No. 4,655,178 to Meneely. By keeping the valves cracked open, less force is necessary to further open the valves against the building cylinder pressure just before top dead center of each compression stroke. This reduces the load on the engine components. However, such systems result in a loss of braking power as a result of air leaving the cylinders through the cracked open exhaust valves on the compression stroke. In addition, they are not easily adapted to many engine brakes which have to be driven by exhaust cams.

Another approach, found for example in U.S. Pat. No. 4,150,640 to Egan or U.S. Pat. No. 4,271,796 to Sickler, is to provide for pressure relief to prevent an overload on the engine. Severe loss of braking power is an undesirable side effect in many cases.

Another approach is an improvement over systems where pressure is relieved, whereby the released fluid is stored both to prevent an overload and then to achieve a more ideal valve opening. U.S. Pat. Nos. 4,706,624 and 4,898,206, both to Meisterick, are examples. Such systems may be somewhat complicated and thus may be expensive or result in reliability problems.

Accordingly, there still remains a need for an engine brake which can overcome timing problems, while avoiding wasteful lost motion and overloading of the normal valve opening mechanism, particularly exhaust cams.

SUMMARY OF THE INVENTION

The invention addresses the problems described above by providing a compression release brake for a diesel engine having a plurality of engine cylinders. The brake includes an hydraulically interconnected master and slave cylinder combination for each engine cylinder in a housing. Each combination has a slave piston assembly for operatively engaging the exhaust valve of each cylinder and a master piston for operatively engaging a component of the engine which moves just prior to top dead center of each compression stroke of each cylinder so the slave piston assembly then cracks open the exhaust valve. The combination is two staged with a first stage where the effective ratio of the area of the master piston assembly to the area of the slave piston assembly is less than the ratio for the second stage, the first stage beginning when the master piston assembly begins to move on each cycle of the engine in a direction to crack open the exhaust valve of each cylinder until the slave piston assembly has moved sufficiently to open the exhaust valve and release same compressed gases from the engine cylinder. The second stage begins when the first stage is completed and continues at least until the exhaust valve is cracked open a preset amount for proper operation of the brake.

In one example the two stages are in the master cylinder assembly and include a first master piston which moves alone during the first stage and second master piston which moves during the second stage. Preferably the first master piston operatively engages the second master piston to move the second master piston during the second stage.

The compression-release brake preferably includes means for automatically taking up mechanical free play when the brake is mounted on an engine including a bore in the inner master piston and an adjustment piston reciprocatingly mounted in the bore and projecting therefrom for contacting a reciprocating component of the engine. There is a passageway for hydraulic fluid extending through the inner master piston to the bore. A one-way valve admits pressurized hydraulic fluid into the bore to extend the adjustment piston from the inner master piston and inhibits a return flow of hydraulic fluid out of the bore.

Alternatively the two stages may be in the slave cylinder assembly and include a first slave piston which moves during the first stage only and a second slave piston which moves alone during the second stage. Perferably the first slave piston operatively engages the second slave piston to move the second slave piston during the first stage.

The invention offers significant advantages when compared with the prior art. Although the device is mechanically quite simple, it overcomes the problems discussed above by, in essence, providing a variable ratio master piston. During the inital motion, the master piston has a smaller cross section compared with the slave piston assembly. Therefore, the inital motion displaces less hydraulic fluid towards the slave cylinder than conventional engine brakes having only a single ratio. Therefore, the timing gap between the slave piston and the exhaust valve to be cracked open can be appreciably reduced. Furthermore, the amount of hydraulic fluid displaced into the slave cylinder to take up the gap is decreased, reducing the total amount of hydraulic fluid in the combined master/slave cylinder assembly. This reduces problems associated with compressibility of the fluid. Once the gap between the slave piston and the exhaust valve is taken up and the exhaust valve is opened to release some gases from the cylinder, the second stage is used to fully crack open the exhaust valve. Because the ratio of the master piston area to the slave piston area is reduced during the first stage, the load on the valve opening mechanism is reduced. Once the exhaust valve is cracked open, the operation of the second stage begins. Because the load on the master piston is appreciably reduced once the valve has been cracked open, the higher ratio can then be employed to speed up the process of cracking open the exhaust valve prior to top dead center of the compression stroke.

Desirably engine brakes have automatic devices for taking up free play between the master piston and the rocker arm adjustment screw or other valve opening device being employed. Conventional devices are not well adapted to the engine brake with a variable ratio master piston. The means for automatically taking up mechanical free play described above allows the invention to adapt to different engines without necessitating manual adjustment. However, manual means such as adjustment screws can be employed as a substitute for the automatic means described above.

DESCRIPTION OF THE PREFERRED EMBODIMENTS

Figure 1:
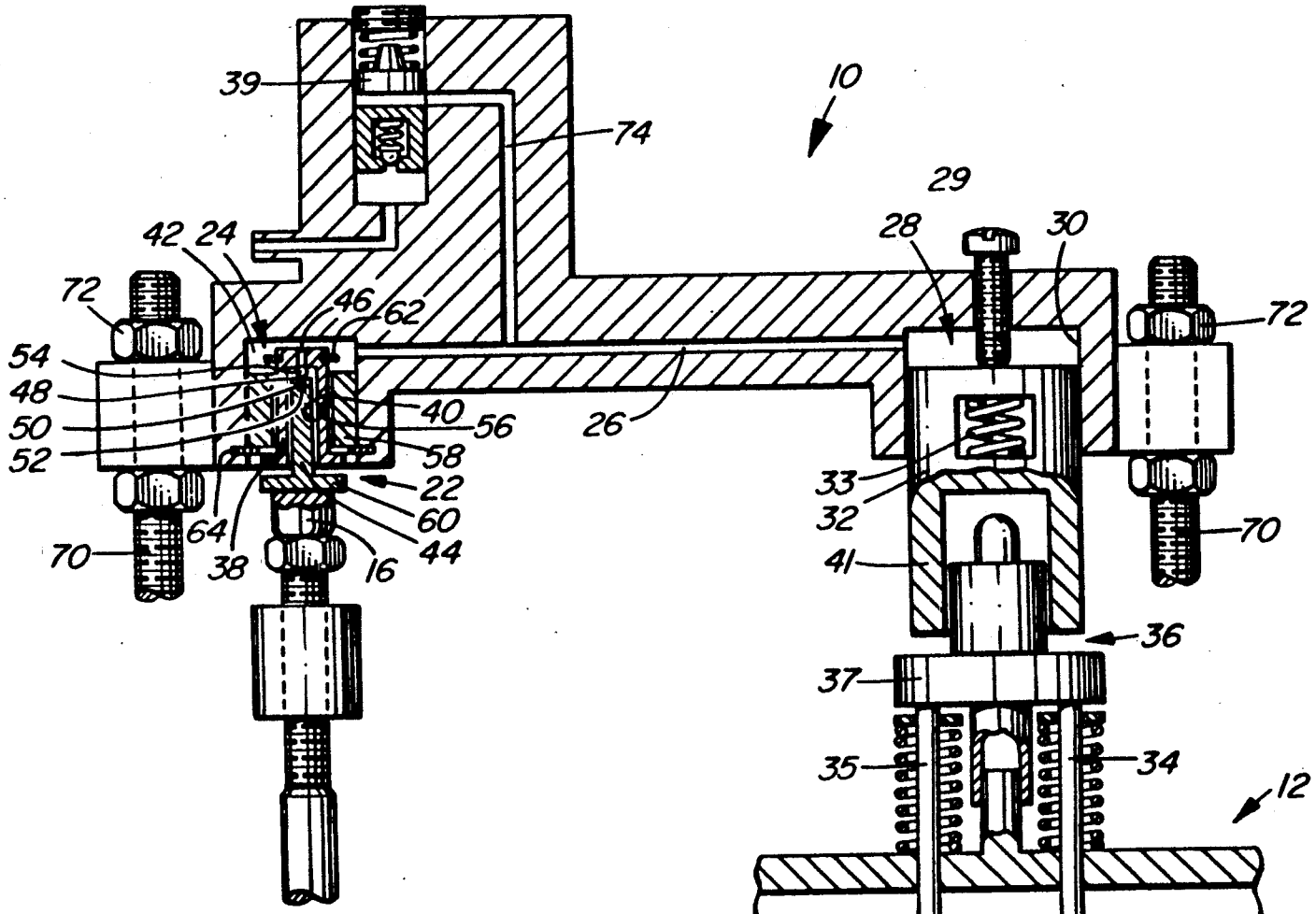
FIG. 1 is a diagrammatic side section of an engine brake according to a first embodiment at the the invention and a fragment of a diesel engine on which the brake is mounted.

Referring to FIG. 1, this shows a compression-release type brake 10 installed on a diesel engine shown in fragment at 12. As is conventional, this brake employs a reciprocating engine component to crack open the exhaust valves 18 and 19 of engine cylinder 20 just before top dead center of the compression stroke when the throttle of the diesel engine is closed. In this case rocker arm 16 for the exhaust valve of another cylinder is used. An adjustment screw on the rocker arm could also be utilized. The rocker arm 16 is selected because it moves upwardly just prior to top dead center of cylinder 20 on the compression stroke. For example, rocker arm 16 may be the rocker arm for No. 6 cylinder of a six cylinder engine, while cylinder 20 is No. 5 cylinder of the engine.

Figure 3:
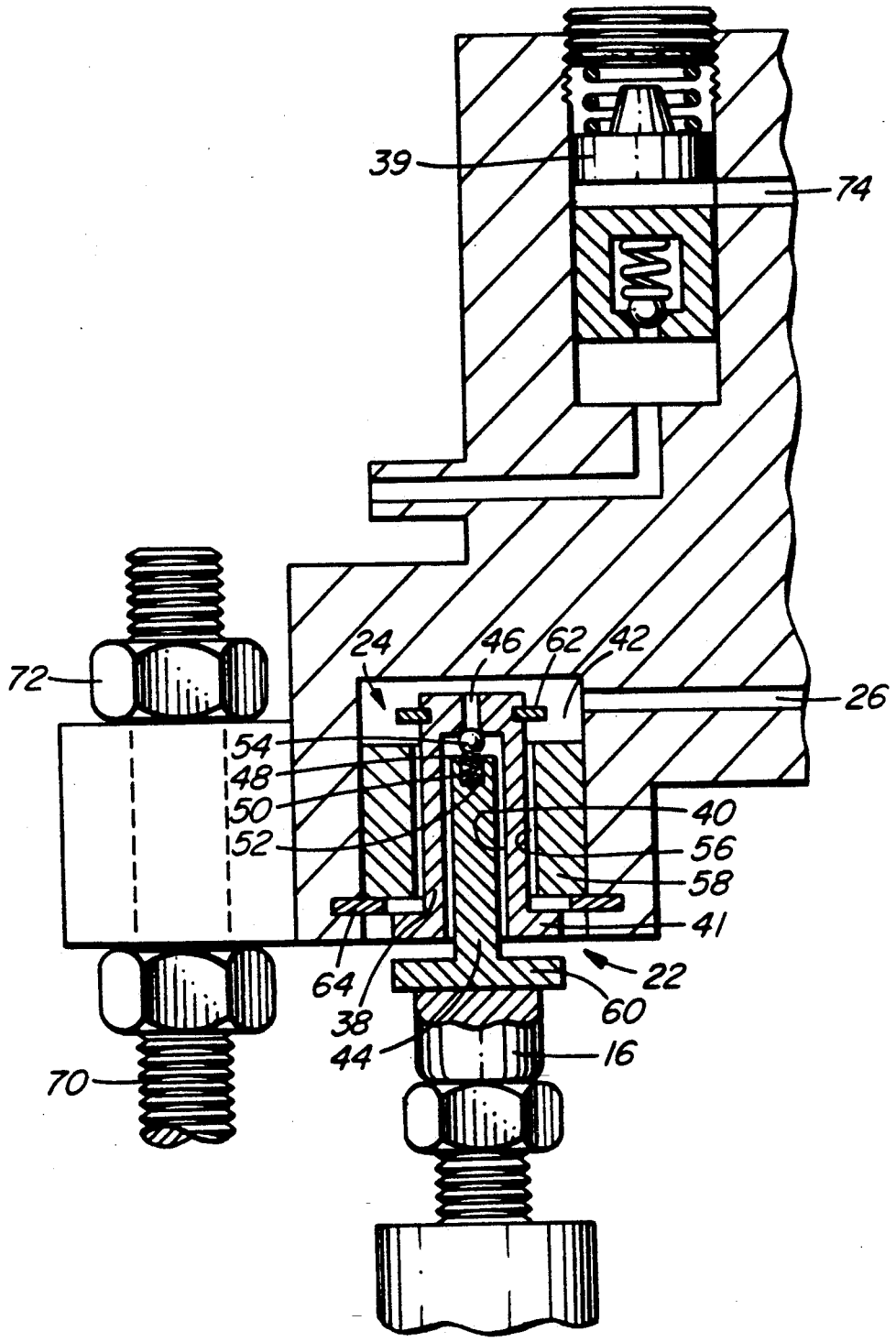
FIG. 3 is an enlarged view of the master piston assembly of FIG. 1.

There is a master piston assembly 22 forming a part of a master cylinder assembly 24 shown best in FIG. 3. Master piston assembly 22 is displaced upwardly when rocker arm 16 moves up. Hydraulic fluid in the cylinder 42 of assembly 24 is displaced through an hydraulic conduit 26 to a slave cylinder assembly 28, as shown in FIG. 1, including a slave cylinder 30 and a slave piston 32. The slave piston 32 operatively contacts valve stems 34 and 35 of exhaust valves 18 and 19. The word "operatively" is used because there is no physical contact between the piston and the valve stem in this engine where two exhaust valves are used for each cylinder. The slave piston has a bifurcated portion 41 which contacts the crosshead 37 of the two exhaust valves. This arrangement is simplified for illustrative purposes. The upper limit of travel of the slave piston can be adjusted using adjustment screw 29.

In normal use, the master cylinder assembly, slave cylinder assembly and the conduit 26 form a closed hydraulic system filled with engine oil during operation of brake 10. This is achieved in the conventional manner using an electrical switch controlling a solenoid valve 39. This prevents oil from draining through conduit 74.

There is a gap 36 illustrated between the top of crosshead 37 and slave piston 32. This gap is used for timing purposes. As explained above, rocker arm 16 begins to move too early for cracking open valves 18 and 19 just prior to top dead center. Accordingly, gap 36 allows the master piston assembly to move a limited distance until the time is appropriate for the valves 18 and 19 to be cracked open. Once the gap 36 is closed, further displacement of the master piston assembly by rocker arm 16 forces the valves 18 and 19 to open against the pressure of the compressed gases inside cylinder 20.

As described thus far, the engine brake 10 is similar to conventional engine brakes of the same type. However, conventional brakes have only a fixed ratio between the area of the master piston and the area of the slave piston. This ratio is important. The amount the slave piston moves is reduced when the master piston is smaller because the amount of hydraulic fluid displaced into the slave cylinder is thereby reduced. However, when the size of the master piston is reduced, the load placed on the rocker arm 16 is reduced. Thus the problem is finding a ratio of the cross-sectional areas of the master piston and slave piston which will, at the same time, provide enough movement of the slave piston to open the valves 18 and 19 and yet not provide too much of a load on rocker arm 16 and the valve opening mechanism. This problem is compounded by the existence of gap 36 which, as described above, is necessary for timing purposes. When only a fixed ratio is used, an appreciable amount of master piston movement is wasted in taking up this gap. The gap must be relatively large to accommodate the amount of movement of the master piston which takes place before it is appropriate to crack open the valve.

The invention however overcomes this problem by providing a variable ratio of the master piston area to the slave piston area. The embodiment of FIG. 1 and 3 uses a two-stage, or variable ratio, master piston assembly. In effect, a smaller master piston is employed during the initial movement of rocker arm 16 until the timing is appropriate to crack open valves 18 and 19. This smaller master piston is utilized for the initial cracking open of valves 18 and 19 when the greatest force must be exerted on the valves to overcome the compressional forces of the gases inside the cylinder 20. Once the valves are initially opened, compressed gases are discharged from the cylinder into the exhaust system, thereby equalizing pressure on both sides of valves 18 and 19 and appreciably reducing the force necessary to continue opening the valve to their fully cracked open positions. In the embodiment illustrated in FIG. 3 this smaller master piston is inner master piston 38. It may be seen that the area of piston 38 is appreciably smaller than that of the inside of master cylinder 42. Accordingly, its movement brings about a relatively small displacement of hydraulic fluid through conduit 26 into slave cylinder 30 to move slave piston 32 a small amount relative to a master piston having the same diameter as cylinder 42. This reduces the necessary size of gap 36, resulting in less lost motion for the system. Furthermore, it provides a relatively large force to initially crack open the valves 18 and 19, while employing the safe amount of loading permissable on rocker arm 16.

It is desirable, though not necessary, that the master piston assembly 22 of brake 10 be automatically adjustable for mounting on different diesel engines 12. The distance between the bottom of the master piston assembly and rocker arm 16 , when first installed, will vary for different engines. Brake 10 has means for automatically taking up mechanical free play between the master piston assembly and rocker arm 16 when the brake 10 is mounted on an engine 12. In this embodiment, this means includes a bore 40 which extends through the inner master piston 38 coaxially with the bore of master cylinder 42. An adjustment piston 44 is reciprocatingly mounted in the bore and projects below inner master piston 38. The adjustment piston 44 of this particular embodiment has a flange 60 at the bottom thereof designed to engage rocker arm 16.

There is a passageway 46 through the top of the inner master piston extending into bore 40 for a flow of hydraulic fluid from the master cylinder 42 into the bore. A one-way valve 48 at the top of the inner master piston includes a coil spring 50 secured within a socket 52 in the top of the adjustment piston 44 with a ball 54 fixedly secured thereto.

Jacking down of the adjustment piston beyond the desired point is prevented by the attachment of ball 54 to spring 50. If the adjustment piston moves down beyond a set point, ball 54 moves out of contact with the lower end of passageway 46, thus allowing an outflow of oil from bore 40 and allowing the adjustment piston to move upwardly relative to the inner master piston.

The inner master piston 38 is reciprocatingly received within a bore 56 in an outer master piston 58. Bore 56 is coaxial with the master cylinder 42. In this particular embodiment, the inner master piston is concentric with the outer master piston and master cylinder 42.

Flange 41 at the bottom of the inner master piston limits its upward travel relative to the outer master piston. A snap ring 62 fitted to a groove at the top of the inner master piston limits downwards travel of the inner master piston relative to the out master piston.

The outer master piston 58 is reciprocatingly received in the master cylinder 42 which has a snap ring 64 in a groove in the wall thereof below the outer master piston. The snap ring limits its downward movement.

OPERATION

As described, engine brake 10 is mounted on the engine 12 in the conventional manner, in this case by bolting it between the cylinder head cover and the cylinder head of the engine using studs 70 and nuts 72. The brake is configured so that there is one slave cylinder 30 for the cylinder of the engine and each slave piston is located to operatively engage the exhaust valves of the cylinder. The master cylinder assemblies are located so as to engage a reciprocating component such as exhaust valve rocker arm 16 for another cylinder of the engine. The component is selected because it is actuated just prior to top dead center of the cylinder for the exhaust valve to be cracked open. In the conventional manner, pressurised hydraulic fluid is supplied to the hydraulic system comprising the master cylinder assembly, the slave cylinder and hydraulic conduit 26, by operating a solenoid valve from the cab of the truck. This closes valve 39 which blocks oil from draining through conduit 74. Spring 33 within slave piston 32 has sufficient force to resist downward movement of the slave piston against such pressure of hydraulic fluid prior to actuation of the master piston. This preserves gap 36 so that exhaust valves 18 and 19 are not cracked open too early by actuation of the master piston.

The pressurised fluid within cylinder 42 acts upon the outer master pistion 58, forcing it downwards until it contacts snap ring 64. The fluid then displaces inner master piston 38 downwardly until snap ring 62 contacts the top of outer master piston 58. The fluid then moves through passageway 46, displacing ball 54 of one way valve 48 downwardly. The fluid then moves adjustment piston 44 down until flange 60 contacts rocker arm 16. Thus free play between the master piston assembly and the rocker arm is automatically taken up.

When rocker arm 16 begins to move up, the adjustment piston 44 and the inner master piston 38 act as a unit because of the fluid trapped within bore 40 below one way valve 48. The rocker arm moves inner master piston 38 until flange 41 contacts the bottom of outer master piston 58. The gap between flange 41 and the outer master piston, when the inner master piston is deployed fully downwards, is set so gap 36, shown in FIG. 1, is taken up and valves 18 and 19 are opened slightly, just as flange 41 contacts the outer master piston. The outer master piston then begins to move upwardly to fully crack open the valves.

Because inner master piston 38 has a cross section significantly smaller than the overall cross section of master cylinder 42, the inner master piston moves the slave piston a smaller distance compared with the entire master piston assembly for a particular amount of upward movement. However, the force applied to valve stems 34 and 35 is greater for the same amount of force exerted by rocker arm 16. The inner master piston therefore provides the initial force required to overcome the strong resistance to initially cracking open valves 18 and 19 against the pressure of gases in cylinder 20.

Brake 10 is timed so that flange 41 contacts the bottom of the outer master piston 58 as soon as valves 18 and 19 have been intially opened. At this point, the inner master piston 38 and outer master piston 58 operate as a unit, occupying the entire area of cylinder 42. The effective area of the master piston assembly is thereby appreciably increased, pumping a much larger volume of hydraulic fluid towards the slave cylinder assembly for the same amount of movement of rocker arm 16 compared with movement of the inner master piston alone. After gases have been released from cylinder 20, the resistance to further opening is decreased and more rapid and complete cracking open of valves 18 and 19 can be accomplished without placing an excessive force on rocker arm 16. This is because the released gases equalize the pressure above and below valves 18 and 19 to some extent.

After valves 18 and 19 have been cracked open as desired, rocker arm 16 eventually begins to move downwardly. Spring 33 returns slave piston 32 upwardly to its rest position against adjustment screw 29, restoring gap 36. The pressurised hydraulic fluid in cylinder 42 moves inner master piston 38 downwardly until snap ring 62 contacts outer master piston 58. At that point, the pressure begins to move outer master piston 58 downwardly until it contacts snap ring 64. The cycle then begins again.

When the driver of the vehicle wishes to commence normal vehicle operation, he actuates the switch in the cab of the truck which opens valve 39 and allows the engine oil, which is normally the hydraulic fluid in the system just described, to drain through conduit 74. Motion of the master piston assembly no longer causes downward movement of the slave piston.

ALTERNATIVES AND VARIATIONS

While the automatically adjusting feature employing adjustment piston 44 is preferred, it is not a necessary feature of this engine brake. The engine brake could be specifically designed for a particular engine so that the bottom of the inner master piston 38 would be correctly positioned to engage the particular rocker arm 16.

Other arrangements of the master piston assembly 22 are also possible, apart from the concentric inner master piston 38 and outer master piston 58 as shown, whereby the initial movement of the rocker arm or other reciprocating engine component causes initial movement of a master piston component with a relatively small cross-sectional area until the exhaust valves 18 and 19 are initially opened. After that point, the area of the master piston effectively increases to fully open the valve.

Figure 2:
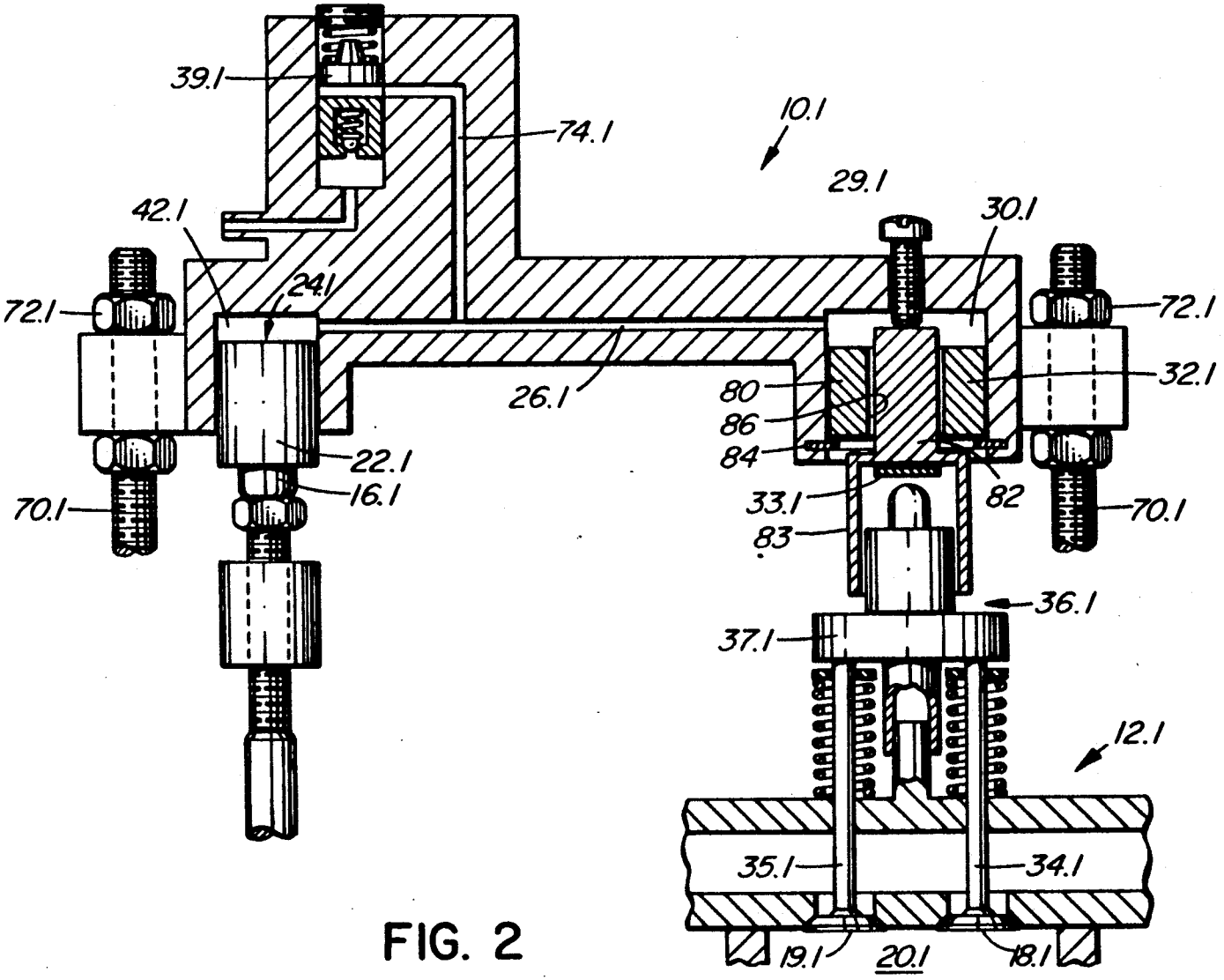
FIG. 2 is a view similar to FIG. 1 of an engine brake according to a second embodiment of the invention mounted on a diesel engine.
Figure 4:
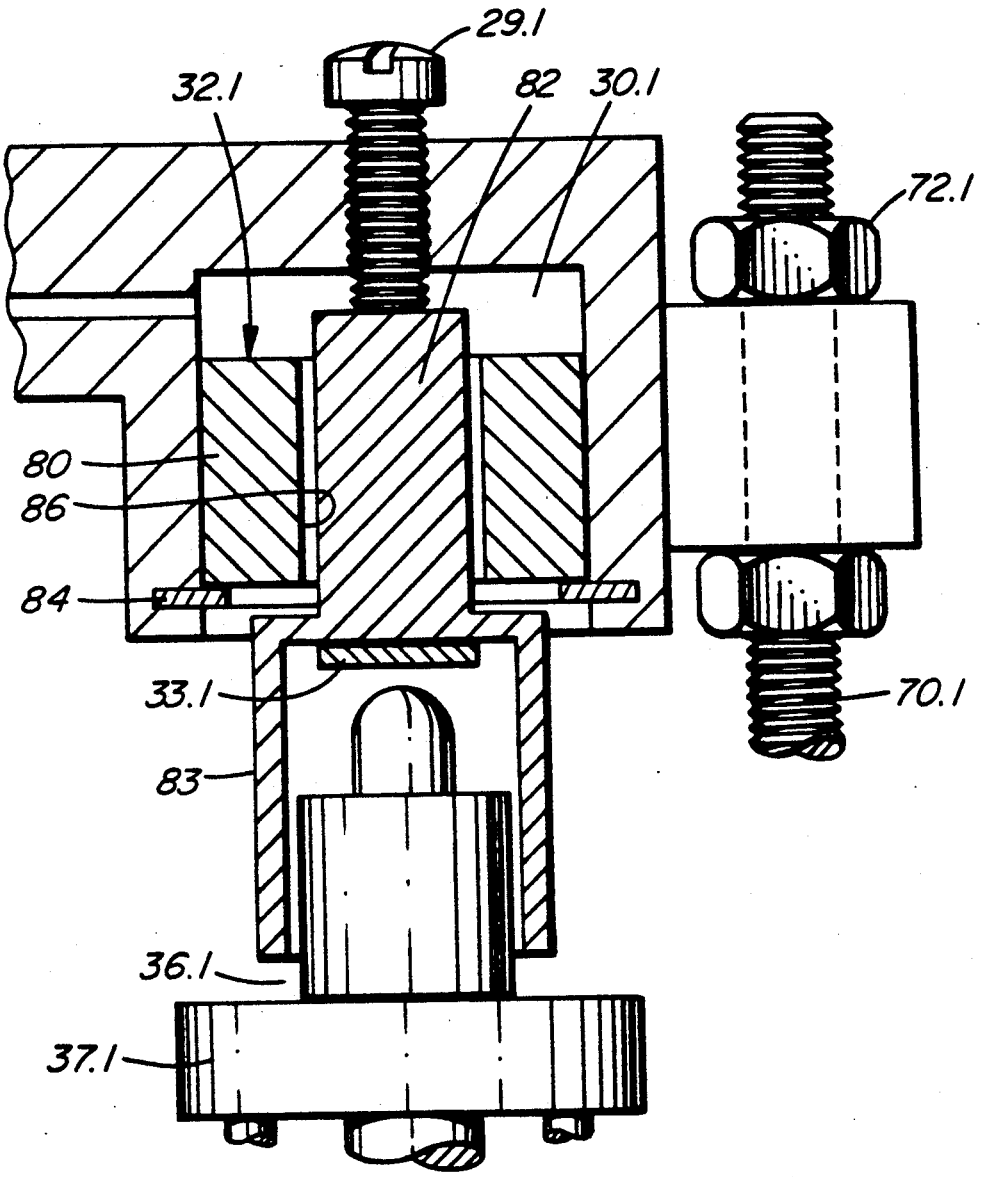
FIG. 4 is an enlarged view of the slave piston assembly of FIG. 2.

Furthermore, as shown in the alternative embodiment of FIG. 2 and 4, the ratio of the master piston area compared to the slave piston area can be increased by effectively reducing the area of the slave piston instead of increasing the area of the master piston as in the previous embodiment. In this form of the invention, where like parts have like numbers with the additional designation ".1", the master piston assembly 24.1 is conventional, having but a single master piston 22.1 operatively contacting rocker arm 16.1. Hydraulic conduit 26.1 connects the master cylinder 42.1 to slave cylinder 30.1. Slave piston assembly 32.1 is positioned to act on crosshead 37.1 which acts on valve stems 34.1 and 35.1 of exhaust valves 18.1 and 19.1 of engine cylinder 20.1.

Initial upward movement of rocker arm 16.1 moves master piston 22.1 upwards, thus pumping hydraulic fluid into the slave cylinder 30.1. The fluid acts upon the slave piston assembly 32.1 which includes an outer slave piston 80 and an inner slave piston 82. Piston 82 has a bifurcated portion 83 at the bottom thereof for contacting crosshead 37.1. There is a snap ring 84 in the wall of cylinder 30.1 which limits downward movement of outer slave piston 80. The inner slave piston is biased upwardly by a leaf spring 33.1. Inner slave piston 82 is reciprocatingly received in a bore 86 through the center of the outer slave piston which extends coaxially with cylinder 30.1.

The apparatus is arranged so that the bottom of the outer slave piston contacts the snap ring 84 just after valves 18.1 and 19.1 have been cracked open enough to release some gases from cylinder 20.1. After that point, additional upward movement of rocker arm 16.1 moves master piston 22.1 further upward, pumping additional hydraulic fluid into the slave cylinder. However, because further downward movement of the other slave piston 80 is prevented by snap ring 84, the additional fluid moves only inner slave piston 82. Because the inner slave piston has a much smaller area, the additional fluid moves the inner slave piston down further than it would the entire slave piston assembly. Thus, the pressure on both sides of valves 18.1 and 19.1 having been equalized to some extent, the additional fluid can be used to fully crack open the valves with the remaining motion of rocker arm 16.1 without putting undue force on the rocker arm or the exhaust cam which operates the rocker arm.

It will be appreciated by someone skilled in the art that many of the details provided above are given by way of example only and can be modified without departing from the scope of the invention which is to be determined from the following claims.

What is claimed is:

1. A compression release brake for a diesel engine having a plurality of engine cylinders, each having an exhaust valve, the brake comprising:

a housing; and an hydraulically interconnected master and slave cylinder combination for each engine cylinder, each said combination having a slave piston assembly for operatively engaging the exhaust valve of said each engine cylinder and a master piston assembly for operatively engaging a component of the engine which moves just prior to top dead center of each compression stroke of said each engine cylinder so the slave piston assembly then cracks open said exhaust valve of said each engine cylinder, each said master and slave cylinder combination being two staged with a first stage wherein the effective ratio of the area of the master piston assembly to the area of the slave piston assembly is less than said ratio for the second stage, the first stage beginning when the master piston assembly begins to move on each cycle of the engine in a direction to crack open the exhaust valve of said each cylinder until the slave piston assembly has moved sufficiently to open the exhaust valve of said each cylinder and release some compressed gases, the second stage beginning when the first stage is completed and continuing at least until the exhaust valve is cracked open a preset amount for proper operation of the brake.

2. A compression release brake as claimed in claim 1, the master and slave cylinder combination including a master cylinder assembly, the two stages being in the master cylinder assembly and including a first master piston which moves alone during the first stage and a second master piston which moves during the second stage.

3. A compression release brake as claimed in claim 2, wherein the first master piston operatively engages the second master piston to move the second master piston during the second stage.

4. A compression release brake as claimed in claim 3, wherein the first master piston is reciprocatingly mounted in the second master piston, the component of the engine operatively engaging the first master piston.

5. A compression release brake as claimed in claim 4, wherein the first master piston is concentric with the second master piston, has a smaller cross-sectional area than the second master piston and has a stop for engaging the second master piston to move the second master piston at the end of said first stage.

6. A compression release brake as claimed in claim 5, further including means for automatically adjusting the compression release brake including an adjustment piston reciprocatingly mounted in an adjustment cylinder within the first master piston and which operatively contacts said engine component, a passageway through the first master piston to the adjustment cylinder and a one-way valve for admitting pressurized fluid from the master cylinder assembly into the adjustment cylinder and inhibiting a reverse flow of hydraulic fluid from the adjustment cylinder.

7. A compression release brake as claimed in claim 6, wherein the passageway is in the top of the first master piston, the one-way valve including a ball connected to a spring mounted on the top of the adjustment piston and biased towards the passageway.

8. A compression release brake as claimed in claim 1, wherein the two stages are in the slave cylinder assembly and include a first slave piston which moves during the first stage only and a second slave piston which moves alone during the second stage.

9. A compression release brake as claimed in claim 8, wherein both the first slave piston and the second slave piston move during the first stage.

10. A compression release brake as claimed in claim 9, wherein the second slave piston is reciprocatingly mounted in the first slave piston, the second slave piston operatively contacting said each exhaust valve of the engine.

11. A compression release brake as claimed in claim 10, wherein the slave cylinder assembly has a stop to prevent movement of the first slave piston after the first stage.

12. A compression release brake as claimed in claim 11, wherein the second slave piston is concentric with the first slave piston and has a smaller cross-sectional extent.

13. An apparatus comprising:

a diesel engine having a plurality of engine cylinders, each said engine cylinder having an exhaust valve, and a component which moves just prior to top dead center of each engine cylinder on each compression stroke; and a compression release brake mounted on the engine, the brake having a housing with an hydraulically interconnected master and slave cylinder combination for each engine cylinder, each of the master and slave cylinder combinations having a slave piston assembly which operatively engages the exhaust valve of one of the engine cylinders and a master piston assembly which operatively engages said component to crack open the exhaust valve of said each cylinder thereof near top dead center of each compression stroke, each of the master and slave cylinder combinations being two staged with a first stage where the effective ratio of the area of the master piston assembly to the area of the slave piston assembly is less than during the second stage, the first stage beginning when the master piston assembly begins to move on each engine cycle in a direction to crack open the exhaust valve of said each cylinder until the slave piston assembly has moved sufficiently to open the exhaust valve to release some compressed gases from said each cylinder, the second stage beginning at the end of the first stage and lasting at least until the exhaust valve is cracked open a preset amount.

14. An apparatus as claimed in claim 13, wherein the component is part of a valve opening mechanism for an engine cylinder other than said each cylinder.

15. An apparatus as claimed in claim 13, wherein the component is a rocker arm for opening an exhaust valve of the engine on an engine cylinder other than said each cylinder.

16. An apparatus as claimed in claim 13, wherein the two stages are in the master cylinder assembly and include a first master piston and a second master piston, the first master piston moving alone during the first stage, the first master piston operatively engaging the second master piston to move the second master piston during the second stage.

17. An apparatus as claimed in claim 16, wherein the first master piston is reciprocatingly mounted in the second master piston, the component of the engine operatively contacting the first master piston, the first master piston being concentric with the second master piston, having a smaller cross-sectional area than the second master piston and having a stop for engaging the second master piston to move the second master piston at the end of the first stage.

18. An apparatus as claimed in claim 17, further including means for automatically adjusting the compression release brake including an adjustment piston reciprocatingly mounted in an adjustment cylinder within the first master piston, the adjustment piston projecting from the first master piston to operatively contact the engine component, a passageway through the first master piston to the adjustment cylinder and a one-way valve for admitting pressurized hydraulic fluid into the adjustment cylinder and inhibiting a reverse flow of hydraulic fluid.

19. An apparatus as claimed in claim 13, wherein the two stages are in the slave piston assembly and include a first slave piston which moves during the first stage and a second slave piston which moves alone during the second stage.

20. An apparatus as claimed in claim 19, wherein the master and slave cylinder combination includes a slave cylinder and the second slave piston is reciprocatingly mounted in the first slave piston, the second slave piston operatively contacting the exhaust valve of said each cylinder of the engine, the second slave piston moving with the first slave piston during the first stage, the slave cylinder having a stop to prevent further movement of the first slave piston after the first stage.

21. A method for braking a multi-cylinder diesel engine comprising the steps of initially releasing some compressed gases from each engine cylinder near top dead center of each compression stroke of each cycle of the engine by forcing open the exhaust valve with a slave piston assembly of a master and slave cylinder combination, the slave piston assembly being moved by a master piston assembly which operatively engages an engine component which moves just prior to top dead center of each compression stroke of the cylinder, increasing the effective ratio of the area of the master piston assembly to the area of the slave piston assembly after some compressed gases are released from said each cylinder and opening the exhaust valve to a preset fully cracked-open position after said effective ratio is increased, so loading on the engine component is reduced when the exhaust valve is being forced open and the rate of opening the exhaust valve to the fully cracked-open position is increased after pressure above and below the exhaust valve becomes more equalized and the force on the master piston assembly is thereby reduced.

* * * * *